United States Patent [19]

Kobayashi et al.

[11] Patent Number: 4,469,073

[45] Date of Patent: Sep. 4, 1984

[54] ELECTRONIC FUEL INJECTING METHOD AND DEVICE FOR INTERNAL COMBUSTION ENGINE

[75] Inventors: Nobuyuki Kobayashi, Toyota; Toshiaki Isobe, Nagoya; Teruo Fukuda, Toyota, all of Japan

[73] Assignee: Toyota Jidosha Kogyo Kabushiki Kaisha, Toyota, Japan

[21] Appl. No.: 390,115

[22] Filed: Jun. 18, 1982

[30] Foreign Application Priority Data

Feb. 23, 1982 [JP] Japan ..... 57-27842

[51] Int. Cl.[3] ..... F02B 3/00

[52] U.S. Cl. ..... 123/492; 123/493

[58] Field of Search ..... 123/492, 493

[56] References Cited

U.S. PATENT DOCUMENTS

| | | | |
|---|---|---|---|
| 3,926,153 | 12/1975 | Reddy | 123/492 |
| 4,159,697 | 7/1979 | Sweet | 123/492 |
| 4,266,275 | 5/1981 | Marchak | 123/492 |
| 4,334,513 | 6/1982 | Nakajima | 123/492 |
| 4,355,359 | 10/1982 | Kanegae | 123/492 |
| 4,359,993 | 11/1982 | Carlson | 123/493 |

*Primary Examiner*—Ronald B. Cox

*Attorney, Agent, or Firm*—Cushman, Darby & Cushman

[57] ABSTRACT

In an electronic fuel injecting method and device for an internal combustion engine, wherein a basic injection time is obtained in accordance with an intake pressure of the engine and an engine rotational speed, and, during transition, the basic injection time is corrected in accordance with the operating conditions of the engine so as to determine a fuel injection time, out of three factors including an after-idle increase correction in which a correction value is increased to a predetermined level when an idle switch is turned "OFF", a throttle valve opening increase or decrease correction in which a correction value is obtained in accordance with a changing speed in opening of a throttle valve, and an intake pressure increase or decrease correction in which a correction value is obtained in accordance with a changing speed of the intake pressure, at least two factors are combined to obtain an increase correction value for acceleration or a decrease correction value for deceleration, and, when the factors are overlapped in value, the increase correction value for acceleration or the decrease correction value for deceleration is obtained through the maximal values or the minimal values thereof.

13 Claims, 5 Drawing Figures

ELECTRONIC FUEL INJECTING METHOD AND DEVICE FOR INTERNAL COMBUSTION ENGINE

BACKGROUND OF THE INVENTION

1. Field of the Invention

This invention relates to an electronic fuel injecting method and device for an internal combustion engine, and more particularly to improvements in an electronic fuel injecting method and device suitable for use in an internal combustion engine for a motor vehicle having a D-J type electronic fuel injection system, wherein a basic injection time is obtained in accordance with an intake pressure of the engine and an engine rotational speed, and, during transition, the basic injection time is corrected in accordance with the operating conditions of the engine so as to determine a fuel injection time.

2. Description of the Prior Art

The methods of supplying a mixture of a predetermined air-fuel ratio to combustion chambers of an internal combustion engine for a motor vehicle and the like include one using an electronic fuel injection system. According to this method, a plurality of injectors as many as the number of cylinders of the engine or one injector for the injection of fuel into the engine are provided, for example, on an intake manifold or a throttle body of the engine, and the valve-opening time period of the injectors or injector is controlled in accordance with the operating conditions of the engine, so that a mixture of a predetermined air-fuel ratio can be supplied to the combustion chambers of the engine. This electronic fuel injection system is broadly divided into two systems including a so-called L-J type electronic fuel injection system wherein a basic injection time is obtained in accordance with an intake air flowrate of the engine and an engine rotational speed and a so-called D-J type electronic fuel injection system wherein a basic injection time is obtained in accordance with an intake pressure of the engine and an engine rotational speed.

The former can control the air-fuel ratio with high accuracy and is commonly used for the engines of motor vehicles to which is applied exhaust gas purification system. However, in this L-J type electronic fuel injection system, the dynamic range of the intake air flowrate is so wide that the intake air flowrate at the time of high load is increased to about 50 times that at the time of idling, thereby presenting the following disadvantages. Namely, not only the accuracy is decreased when the intake air flowrate is converted into a digital signal, but also a bit length of the digital signal is lengthened when it is desired to improve the counting accuracy in a digital control circuit at the latter stage, whereby an expensive computer is required for the digital control circuit, and moreover, a measuring instrument having a construction with high accuracy such as an air flow meter or the like is required to measure the intake air flowrate, to thereby increase the installation cost.

On the other hand, the latter D-J type electronic fuel injection system has the features that the dynamic range of the intake pressure is so narrow that the variation value of the intake pressure is as low as two to three times, so that, not only the operation in the digital control circuit at the latter stage is facilitated, but also a pressure sensor for detecting the intake pressure is inexpensive. However, as compared with the L-J type electronic fuel injection system, the D-J type electronic fuel injection system has a low control accuracy of the air-fuel ratio, and particularly, has a low acceleration performance during acceleration because the fuel injection time is not increased unless the intake pressure increases, whereby the air-fuel ratio becomes lean temporarily. To obviate the disadvantages as described above, heretofore, there has been taken a measure that an increase correction for acceleration is provided in response to a pulse train fed from a comb-shaped sensor provided on a throttle valve. However, in order to improve the driverability, it is necessary to increase the increase correction to a considerable extent. In that case, the air-fuel ratio has become over-rich, the value of carbon monoxide contained in the exhaust gas has increased to an unusually high extent, so that the air-fuel ratio could not be maintained within a predetermined range suitable for a three-way catalytic converter. This is also true of the case where the fuel injection time is feedback controlled in response to an oxygen concentration sensor provided at the downstream side of the exhaust gas, because the oxygen concentration sensor is slow in response. In consequence, heretofore, it has been conceived that it is difficult to use the D-J type electronic fuel injection system in the engine for the motor vehicle, to which the exhaust gas purification system is applied, requiring the air-fuel ratio control with high accuracy.

Furthermore, in the D-J type electronic fuel injection system, the fuel injection time is not increased during deceleration unless the intake pressure decreases, whereby the air-fuel ratio becomes rich temporarily, thus proving to be low in the exhaust gas purification performance.

SUMMARY OF THE INVENTION

The present invention has been developed to obviate the above-described disadvantages of the prior art and has as its first object the provision of an electronic fuel injecting method for an internal combustion engine, capable of effecting suitable increase or decrease correction during acceleration or deceleration so as to maintain an air-fuel ratio in the vicinity of the stoichiometrical air-fuel ratio, and consequently, capable of making a satisfactory acceleration-deceleration performance compatible with an exhaust gas purification performance.

The present invention has as its second object in addition to its first object the provision of an electronic fuel injecting method of an internal eombustion engine, wherein the increase or decrease correction during transition does not become excessive.

Further, the present invention has as its third object the provision of an electronic fuel injecting method of an internal combustion engine, capable of effecting suitable increase correction during acceleration so as to maintain an air-fuel ratio in the vicinity of the stoichiometrical air-fuel ratio, and consequently, capable of making a satisfactory acceleration performance compatible with an exhaust gas purification performance.

The present invention has as its fourth object in addition to the third object the provision of an electronic fuel injecting method of an internal combustion engine, wherein an increase correction does not become excessive during acceleration.

Further, the present invention has as its fifth object the provision of an electronic fuel injecting method of an internal combustion engine, capable of effecting suitable decrease correction during deceleration so as to maintain an air-fuel ratio in the vicinity of the stoichiometrical air-fuel ratio, and consequently, capable of making a satisfactory deceleration performance compatible with an exhaust gas purification performance.

The present invention has as its sixth object in addition to its fifth object the provision of an electronic fuel injecting method of an internal combustion engine, wherein a decrease correction does not become excessive during deceleration.

Further, the present invention has as its seventh object the provision of an electronic fuel injection device of an internal combustion engine, wherein the above-described objects are achieved.

To achieve the first object, the present invention contemplates that, in an electronic fuel injecting method for an internal combustion engine, wherein a basic injection time is obtained in accordance with an intake pressure of the engine and an engine rotational speed, and, during transition, the basic injection time is corrected in accordance with the operating conditions of the engine so as to determine a fuel injection time, out of three factors including an after-idle increase correction in which a correction value is increased to a predetermined level when an idel switch is turned "OFF", a throttle valve opening increase or decrease correction in which a correction value is obtained in accordance with the changing speed in opening of a throttle valve, and an intake pressure increase or decrease correction in which a correction value is obtained in accordance with the changing speed of an intake pressure, at least two factors are combined to obtain an increase correction value for acceleration or a decrease correction value for deceleration.

To achieve the second object, the present invention contemplates that, in an electronic fuel injecting method for an internal combustion engine like above, out of three factors including an after-idle increase correction in which a correction value is increased to a predetermined level when an idle switch is turned "OFF", a throttle valve opening increase or decrease correction in which a correction value is obtained in accordance with the changing speed in opening of a throttle valve, and an intake pressure increase or decrease correction in which a correction value is obtained in accordance with the changing speed of an intake pressure, at least two factors are combined to obtain an increase correction value for acceleration or a decrease correction value for deceleration, and, when the factors are overlapped in value, the increase correction value for acceleration or the decrease correction value for deceleration is obtained through the maximal values or the minimal values thereof.

To achieve the third object, the present invention contemplates that, in an electronic fuel injecting method for an internal combustion engine like above, out of three factors including an after-idle increase correction in which a correction value is increased to a predetermined level when an idle switch is turned "OFF", a throttle valve opening increase correction in which a correction value is obtained in accordance with the increasing speed in opening of a throttle valve, and an intake pressure increase correction in which a correction value is obtained in accordance with the increasing speed of an intake pressure, at least two factors are combined to obtain an increase correction value for acceleration.

To achieve the fourth object, the present invention contemplates that, in an electronic fuel injecting method of an internal combustion engine like above, out of three factors including an after-idle increase correction in which a correction value is increased to a predetermined level when an idle switch is turned "OFF", a throttle valve opening increase correction in which a correction value is obtained in accordance with the increasing speed in opening of a throttle valve, and an intake pressure increase correction in which a correction value is obtained in accordance with the increasing speed of an intake pressure, at least two factors are combined to obtain a decrease correction value for acceleration, and, when the factors are overlapped in value, the increase correction value for acceleration is obtained through the maximal values thereof.

To achieve the fifth object, the present invention contempleates that, in an electronic fuel injecting method of an internal combustion engine like above, a throttle valve opening decrease correction in which a correction value is obtained in accordance with the decreasing speed in opening of a throttle valve, and an intake pressure decrease correction in which a correction value is obtained in accordance with the decreasing speed of an intake pressure, are combined to obtain a decrease correction value for deceleation.

To achieve the sixth object, the present invention contemplates that, in an electronic fuel injecting method of an internal combustion engine like above, a throttle valve opening decrease correction in which a correction value is obtained in accordance with the decreasing speed in opening of a throttle valve, and an intake pressure decrease correction in which a correction value is obtained in accordance with the decreasing speed of an intake pressure, are combined to obtain a decrease correction value for deceleration, and, when the factors are overlapped in value, the decrease correction value for deceleration is obtained through the minimal values thereof.

To achieve the seventh object, the present invention contemplates that an electronic fuel injection device for an internal combustion engine comprises:

an intake air temperature sensor for detecting the temperature of intake air taken in by an air cleaner;

a throttle sensor including an idle switch for detecting whether a throttle valve is in an idle opening or not and a potentiometer for generating a voltage output proportional to the opening of the throttle valve;

an intake pressure sensor for detecting an intake pressure through a pressure in a surge tank;

an injector for blowing fuel out into the engine;

a crank angle sensor for outputting a crank angle signal in accordance with a rotation of the engine;

a coolant temperature sensor for detecting the temperature of engine coolant; and a digital control circuit wherein a basic injection time is obtained through a map in accordance with an intake pressure fed from the intake pressure sensor and an engine rotational speed obtained from an output from the crank angle sensor, the basic injection time thus obtained is corrected in accordance with an output from the throttle sensor and the temperature of engine coolant fed from the coolant temperature sensor and the like to determine a fuel injection time and output an injector opening time signal to the injector, and further, an after-idle increase correction in which a correction value is increased to a predetermined level when the idle switch is turned "OFF", a throttle valve opening increase or decrease correction in which a correction value is otained in accordance with a changing speed in opening of a throttle valve as detected from an output from the potentiometer of the throttle sensor, and an intake pressure increase or decrease correction in which a correction value is obtained in accordance with the changing speed of an intake pressure as detected from an output from the intake pressure sensor, are combined to obtain an increase correction value for acceleration or a decreae correction value for deceleration, and, when the factors are overlapped in value, the increase correction value for acceleration or the decrease correction value for deceleration is obtained through the maximal values or the minimal values thereof.

According to the present invention, a suitable increase correction for acceleration or decrease correction for deceleration is obtainable, and the air-fuel ratio is maintained in the vicinity of the stoichiometrical air-fuel ratio, so that a satisfactory acceleration or deceleration performance can be made compatible with an exhaust gas purification performance. In consequence, even when a D-J type electronic fuel injection system is used, a highly accurate air-fuel ratio control can be effected.

BRIEF DESCRIPTION OF THE DRAWINGS

The exact nature of this invention, as well as other objects and advantages thereof, will be readily apparent from consideration of the following specification relating to the accompanying drawings, in which like reference characters designate the same or similar parts throughout the figures thereof and wherein.

DETAILED DESCRIPTION OF THE INVENTION

Detailed description will hereunder be given of the embodiments of the present invention with reference to the drawings.

Figure 1:
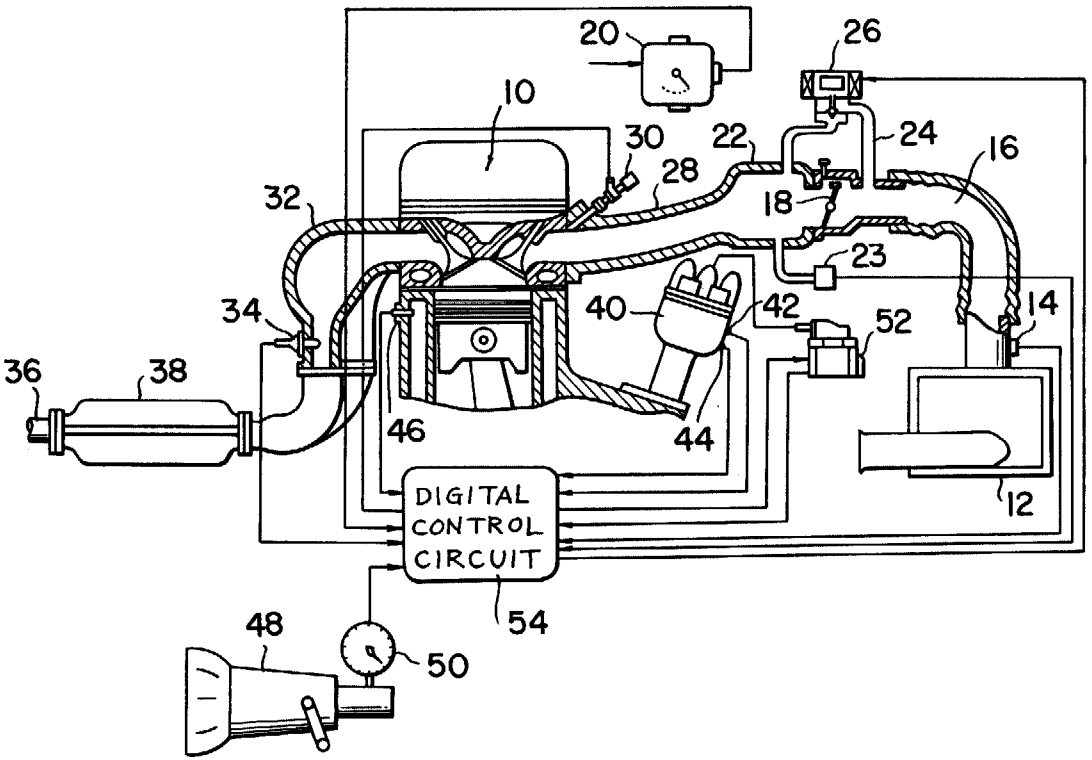
FIG. 1 is a block diagram showing an embodiment of a D-J type electronic fuel injection device of an engine for a motor vehicle adopting the electronic fuel injecting method for an internal combustion engine according to the present invention.
Figure 2:
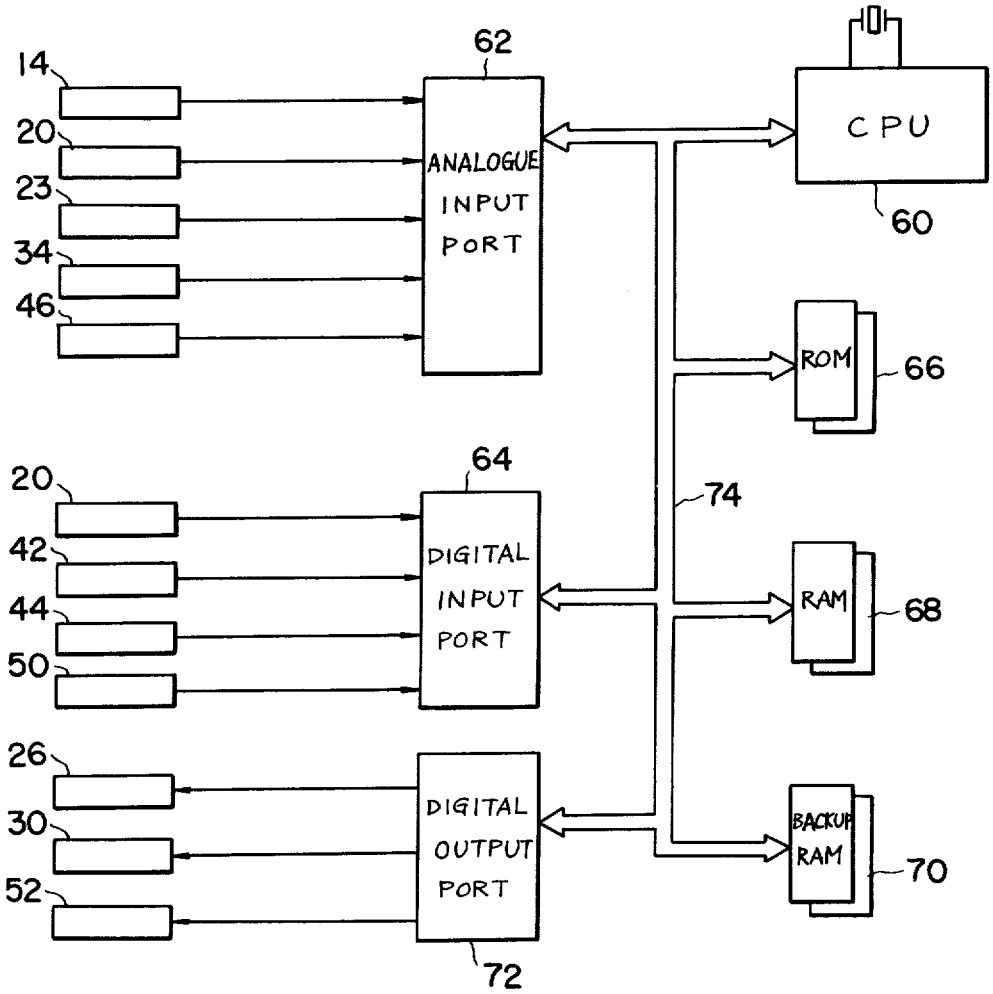
FIG. 2 is a block diagram showing the arrangement of the digital control circuit used in the aforesaid embodiment.

As shown in FIGS. 1 and 2, one embodiment of the D-J type electronic fuel injection device of an engine 10 of a motor vehicle adopting the electronic fuel injecting method for an internal combustion engine according to the present invention, comprising:

an air cleaner 12 for taking in atmosphere;

an intake air temperature sensor 14 for detecting the temperature of intake air taken in through the air-cleaner 12;

a throttle valve 18 provided in an intake air passage 16 and adapted to be interlocked with an accelerator pedal, not shown, provided around a driver's seat to be opened or closed, for controlling the flowrate of intake air;

a throttle sensor 20 including an idle switch for detecting whether the throttle valve 18 is in an idel opening or not and a potentiometer for generating a voltage output proportional to the opening of the throttle valve 18;

a surge tank 22;

an intake pressure sensor 23 for detecting the intake pressure from a pressure in the surge tank 22;

a bypass passage 24 for bypassing the throttle valve 18;

an idle speed control valve 26 provided at the intermediate portion of the bypass passage 24 for controlling the opening area of the bypass passage 24 to control an idle rotational speed;

an injector 30 for blowing fuel out into an intake port of the engine 10;

an oxygen concentration sensor 34 provided on an exhaust manifold 32 for detecting an air-fuel ratio from the residual oxygen concentration in the exhaust gas;

a three-way catalytic converter 38 provided at the intermediate portion of an exhaust pipe 36 at the downstream side of the exhaust manifold 32;

a distributor 40 having a distributor shaft rotatable in operational association with a crankshaft of the engine 10;

a top dead center sensor 42 and a crank angle sensor 44 incorporated in the distributor 40 for outputting a top dead center signal and a crank angle signal in accordance with the rotation of the distributor shaft, respectively;

a coolant temperature sensor 46 provided on an engine block for detecting the temperature of engine coolant;

a vehicle speed sensor 50 for detecting a running speed of the vehicle from the rotational speed of an output shaft of a transmission 48; and a digital control circuit 54, in which a basic injection time per cycle of the engine is obtained from a map in accordance with the intake pressure fed from the intake pressure sensor 23 and the engine rotational speed obtained from an output of the crank angle sensor 44, the basic injection time thus obtained is corrected in accordance with an output from the throttle sensor 20, an air-fuel ratio fed from the oxygen concentration sensor 34, the temperature of engine coolant fed from the coolant temperature sensor 46 and the like to determine a fuel injection time, whereby an injector opening time signal is fed to the injector 30, an ignition timing is determined in accordance with the operating condition of the engine to feed an igniting signal to a coil 52 provided thereon with an igniter, and further, the idle speed control valve 26 is controlled during idling;

is of such an arrangement that, in the digital control circuit 54, an after-idle increase correction in which a correction value is increased to a predetermined level when the idle switch of the throttle sensor 20 is turned "OFF", a throttle valve opening increase or decrease correction in which a correction value is obtained in accordance with a changing speed in opening of a throttle valve as detected from an output from the potentiometer of the throttle sensor 20, and an intake pressure increase or decrease correction in which a correction value is obtained in accordance with the changing speed of an intake pressure as detected from an output from the intake pressure sensor 23, are combined to obtain an increase correction value for acceleration or a decrease correction value for deceleration, and, when the factors are overlapped in value, the increase correction value for acceleration or the decrease correction value for deceleration is obtained through the maximal values or the minimal values thereof.

As detailedly shown in FIG. 2, the digital control circuit 54 comprises:

a Central Processing Unit 60 (hereinafter referred to as "CPU") consisting of a microcomputer for performing various operations; analogue input port 62 provided thereon with a multiplexer for converting analogue signals fed from the intake air temperature sensor 14, the potentiometer of the throttle sensor 20, the intake pressure sensor 23, the oxygen concentration sensor 34, the coolant temperature sensor 46 and the like into digital signals and successively taking into CPU 60; a digital input port 64 for taking into CPU 60 with predetermined timings degial signals fed from the idle switch of the throttle sensor 20, the top dead center sensor 42, the crank angle sensor 44, the vehicle speed sensor 50 and the like; a Read Only Memory 66 (hereinafter referred to as "ROM") for storing programs, various constants or the like; a Random Access Memory 68 (hereinafter referred to as "RAM") for temporarily storing operation data in CPU 60 and the like; a backup Ramdom Access Memory 70 for being supplied thereto with current from an auxiliary power source, when the engine is stopped, to hold memory; a digital output port 72 for outputting the result of operation in CPU 60 with predetermined timings to the idle speed control valve 26, the injector 30, the coil 52 with the igniter and the like; and a common bus 74 for interconnecting the above-described components to one another.

Description will hereunder be given of action.

Firstly, the digital control circuit 54 reads out the basic injection time period TP(PM, NE) from the intake pressure PM fed from the intake pressure sensor 23 and the engine rotational speed calculated from an output of the crank angle sensor 44, through a map previously stored in ROM 66.

Subsequently, the basic injection time period TP (PM, NE) is corrected through the following equation in response to signals from the respective sensors so as to calculate a fuel injection time period TAU.

$$TAU = TP\ (PM, NE) \times (1 + K \times F) \quad (1)$$

where F is a coefficient of correction, and F indicates an increase correction value when it is positive in value, but a decrease correction value when negative. Additionally, K is a multiplying factor of correction for a further correction, and is normally represented by 1.

A fuel injection time signal corresponding to the fuel injection time period TAU thus determined is fed to the injector 30, whereby the injector 30 is opened only for the fuel injection time period TAU in synchronism with the engine rotation, so that fuel can be blown out into the intake manifold 28 of the engine 10.

The increase correction for acceleration or the decrease correction for deceleration in this embodiment is obtained in the following manner.

Figure 3:
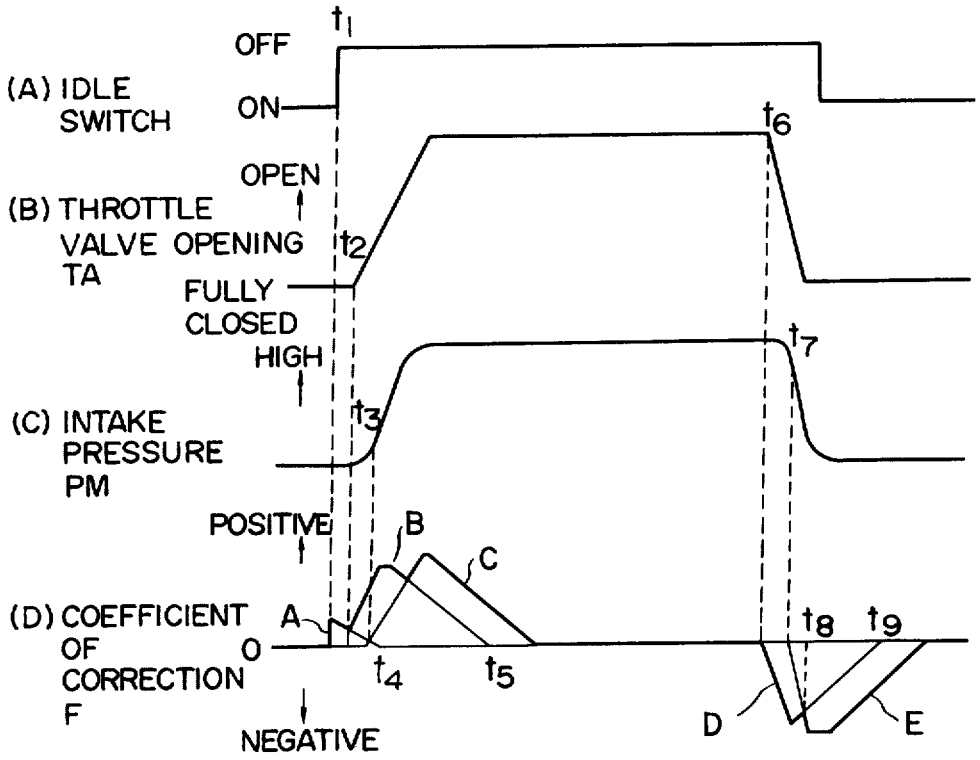
FIG. 3 is a graphic chart showing the conditions of an increase correction for acceleration and a decrease correction for deceleration in the aforesaid embodiment.

As shown in FIG. 3, if the accelerator pedal is depressed during acceleration and the idel switch of the throttle sensor 20 is turned "OFF" at the time $t_1$ as shown in FIG. 3(A), then, prior to increase in the throttle valve opening TA and the intake pressure PM, an after-idle increase correction (hereinafter referred to as "LL increase correction"), in which a very quick correction is obtained, is achieved. Specifically stating, for example, this LL increase correction value is obtained such, firstly, a coefficient F of correction is made to be a predetermined positive value, and subsequently, attenuated every rotation of the engine or every predetermined time interval at a predetermined attenuation rate to zero.

Subsequently, if the throttle valve 18 is further opened and the throttle valve opening TA detected from an output of the potentiometer of the throttle sensor 20 begins to rise from the time $t_2$ as shown in FIG. 3(B), then, prior to the increase in the intake pressure PM, the throttle valve opening increase correction (hereinafter referred to as "TA increase correction"), in which a quick correction is obtained in accordance with the increasing speed of the throttle valve opening TA, is achieved. Specifically stating, for example, this TA increase correction value is obtained such that a value (positive value) obtained by integrating values each corresponding to a varying value with every predetermined time of the throttle valve opening TA is made to be a coefficient F of correction, which is then attenuated every rotation of the engine or every predetermined time interval at a predetermined attenuation rate to zero.

Further, when the intake pressure PM begins to increase posterior to the increase in the throttle valve opening TA, an intake pressure increase correction (hereinafter referred to as "PM increase correction"), in which a highly accurate correction is obtained in accordance with increasing speed of the intake pressure PM, is achieved from the time $t_3$ as indicated by a solid line C in FIG. 3(D). Specifically stating, for example, this PM increase correction value is obtained such that a value (positive value) obtained by integrating values each corresponding to a varying value with every predetermined time of the intake pressure PM is made to be a coefficient F of correction, which is then attenuated every rotation of the engine or every predetermined time interval at a predetermined attenuation rate to zero.

Figure 4:
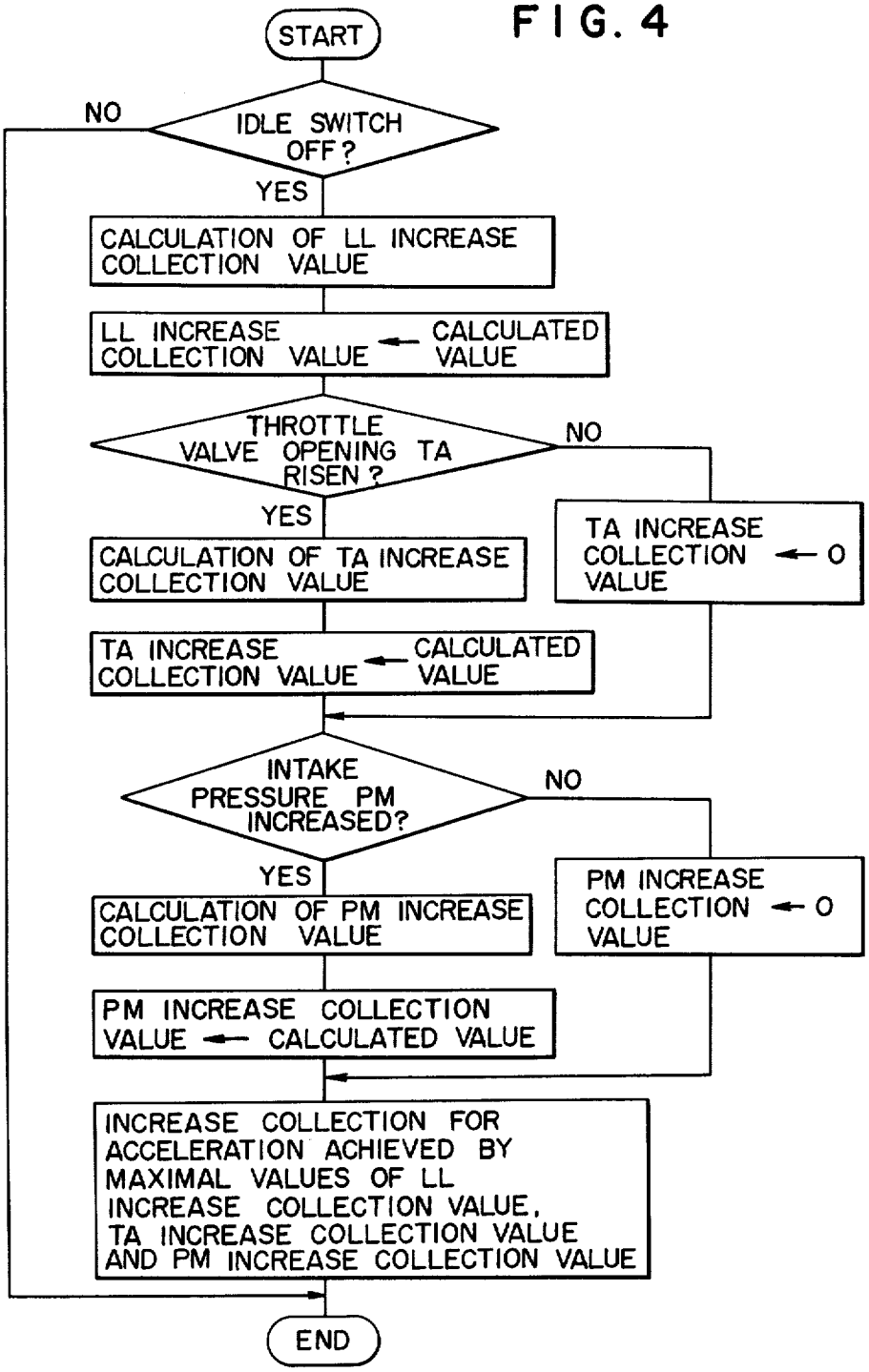
FIG. 4 is a flow chart showing the program of the increase correction for acceleration.

In this case, during a time period between the times $t_2$ and $t_3$, the LL increase correction and the TA increase correction are overlapped with each other, during a time period between the times $t_3$ and $t_4$, all of the increase correction are overlapped, and further, during a time period between the times $t_4$ and $t_5$, the TA increase correction and the PM increase correction are overlapped with each other. If all of the increase corrections are overlapped to obtain the increase correction value, particularly, there will be such a possibility that an excessively increase correction value be brought about due to the influences of the LL increase correction and the TA increase correction which are quick in response, but low in accuracy. In consequence, in this embodiment, the increase correction value for acceleration is obtained by plotting the maximal values of the LL increase correction, the TA increase correction and the PM increase correction as indicated by thick solid line in FIG. 3(D). FIG. 4 shows a program of this increase correction for acceleration.

Next, during deceleration, when the throttle valve 18 begins to be closed from the time $t_6$, prior to a decrease in the intake pressure PM, the throttle valve opening decrease correction (hereinafter referred to as "TA decrease correction"), in which a quick correction is obtained in accordance with the decreasing speed of the throttle valve opening TA, is achieved as indicated by a solid line D in FIG. 3(D). Specifically stating, for example, this TA decrease correction value is obtained such that a value (negative value) obtained by integrating values each corresponding to a varying value with every predetermined time of the throttle valve opening TA is made to be a coefficient F of correction, which is then restored every rotation of the engine or every predetermined time interval at a predetermined restoration rate to zero.

Subsequently, when the intake pressure PM begins to decrease, an intake pressure decrease correction (hereinafter referred to as "PM decrease correction"), in which a highly accurate correction is obtained in accordance with the decreasing speed of the intake pressure PM, is achieved as indicated by a solid line E in FIG. 3(D). Specifically stating, for example, this PM decrease correction value is obtained such that a value (negative value) obtained by integrating values each corresponding to a varying value with every predetermined time of the intake pressure PM is made to be a coefficient F of correction, which is then restored every rotation of the engine or every predetermined time interval at a predetermined restoration rate to zero.

Figure 5:
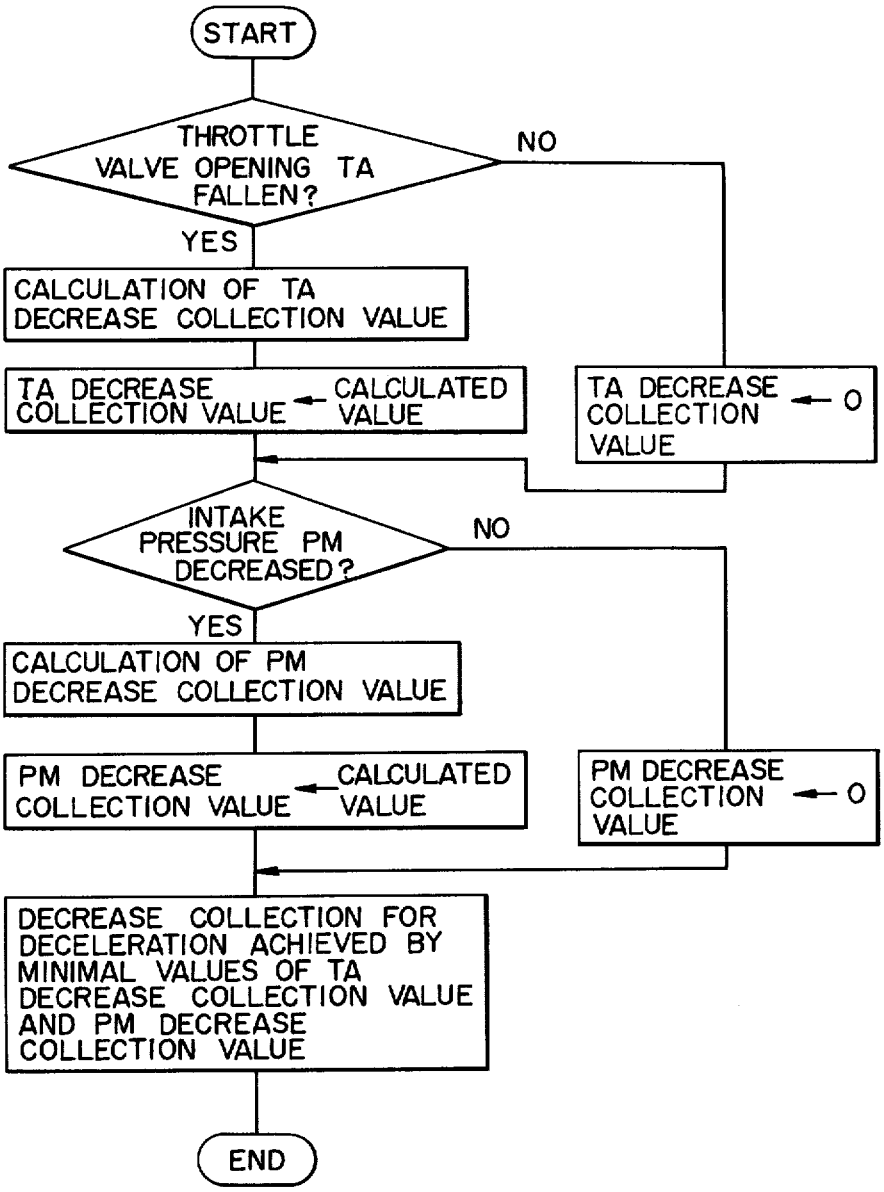
FIG. 5 is a flow chart showing the program of the decrease correction for deceleration.

In this case, if both the TA decrease correction and the PM decrease correction are obtained together when the both decrease corrections are overlapped with each other, there will be a possibility that an excessively decrease correction value be brought about. In consequence, in this embodiment, as indicated by thick solid line in FIG. 3(D), by plotting the minimal values of the TA decrease correction and the PM decrease correction, only the TA decrease correction is obtained during a period between the times $t_7$ and $t_8$ and also only the PM decrease correction is obtained during a period between the times $t_8$ and $t_9$. FIG. 5 shows a program of this decrease correction for deceleration.

As has been described hereinabove, the LL increase or decrease correction being very quick in response, the TA increase or decrease correction being quick in response and the PM increase or decrease correction being high in accuracy are combined to achieve the increase correction for acceleration or the decrease correction for deceleration, whereby, when the accelerator pedal is quickly depressed, an increase correction value of a high level is obtained, and, when the accelerator pedal is slowly and gradually depressed, an increase correction value of a low level is obtained, so that a suitable increase correction or decrease correction can be materialized depending on how the accelerator pedal is depressed, thereby enabling to maintain the air-fuel ratio in the vicinity of the stoichiometrical air-fuel ratio to make the acceleration or deceleration performance compatible with the exhaust gas purification performance.

Additionally, in the above-described embodiment, during acceleration, the LL increase correction, the TA increase correction and the PM increase correction are combined to obtain the acceleration increase correction value, and, during deceleration, the TA decrease correction and the PM decrease correction are combined to obtain the deceleration decrease correction value. However, the combination of the acceleration increase correction values or the deceleration decrease correction values should not necessarily be limited to this, but, for example, the LL increase correction value can be omitted.

It should be apparent to those skilled in the art that the above-described embodiments are merely representative, which represent the applications of the principles of the present invention. Numerous and varied other arrangements can be readily devised by those skilled in the art without departing from the spirit and the scope of the invention.

What is claimed is:

1. Electronic fuel injecting method for an internal combustion engine, wherein a basic injection time is obtained in accordance with an intake pressure of said engine and an engine rotational speed, and, during transition, said basic injection time is corrected in accordance with the operating conditions of said engine so as to determine a fuel injection time, characterized in that an after-idle increase correction in which a correction value is increased to a predetermined level when an idle switch is turned "OFF", a throttle valve opening increase or decrease correction in which a correction value is obtained in accordance with the changing speed in opening of a throttle valve, and an intake pressure increase or decrease correction in which a correction value is obtained in accordance with the changing speed of an intake pressure, at least two factors are combined to obtain an increase correction value for acceleration or a decrease correction value for deceleration.

2. Electronic fuel injecting method for an internal combustion engine, wherein a basic injection time is obtained in accordance with an intake pressure of said engine and an engine rotational speed, and, during transition, said basic injection time is corrected in accordance with the operating conditions of said engine so as to determine a fuel injection time, characterized in that an after-idle increase correction in which a correction value is increased to a predetermined level when an idle switch is turned "OFF", a throttle valve opening increase or decrease correction in which a correction value is obtained in accordance with a changing speed in opening of a throttle valve, and an intake pressure increase or decrease correction in which a correction value is obtained in accordance with a changing speed of the intake pressure, are combined to obtain an increase correction value for acceleration or a decrease correction value for deceleration, and, when the corrections are overlapped in value, the increase correction value for acceleration or the decrease correction value for deceleration is obtained through the maximal values or the minimal values thereof.

3. Electronic fuel injecting method for an internal combustion engine, wherein a basic injection time is obtained in accordance with an intake pressure of said engine and an engine rotational speed, and, during transition, said basic injection time is corrected in accordance with the operating conditions of said engine so as to determine a fuel injection time, characterized in that an after-idle increase correction in which a correction value is increased to a predetermined level when an idle switch is turned "OFF", a throttle valve opening increase correction in which a correction value is obtained in accordance with an increasing speed in opening of a throttle valve, and an intake pressure increase correction in which a correction value is obtained in accordance with a increasing speed of the intake pressure, are combined to obtain an increase correction value for acceleration.

4. Electronic fuel injecting method for an internal combustion engine, wherein a basic injection time is obtained in accordance with an intake pressure of said engine and an engine rotational speed, and, during transition, said basic injection time is corrected in accordance with the operating conditions of said engine so as to determine a fuel injection time, characterized in that an after-idle increase correction in which a correction value is increased to a predetermined level when an idle switch is turned "OFF", a throttle valve opening increase correction in which a correction value is obtained in accordance wih an increasing speed in opening of a throttle valve, and an intake pressure increase correction in which a correction value is obtained in accordance with an increasing speed of the intake pressure, are combined to obtain an increase correction value for acceleration, and, when the increase corrections are overlapped in value, the increase correction value for acceleration is obtained through the maximal values thereof.

5. Electronic fuel injecting method for an internal combustion engine as set forth in any one of claims 1 through 4, wherein said after-idle increase correction is obtained such that, fitstly, a coefficient of correction is made to be a predetermined positive value, and subsequently, attenuated every rotation of the engine or every predetermined time interval at a predetermined attenuation rate to zero.

6. Electronic fuel injecting method for an internal combustion engine as set forth in any one of claims 1 through 4, wherein said throttle valve opening increase correction is obtained such that a positive value obtained by integrating positive values each corresponding to a varying value with every predetermined time of the throttle valve opening is made to be a coefficient of correction, which is then attenuated every rotation of said engine or every predetermined time interval at a predetermined attenuation rate to zero.

7. Electronic fuel injecting method for an internal combustion engine as set forth in any one of claims 1 through 4, wherein said intake pressure increase correction is obtained such that a positive value obtained by integrating positive values each corresponding to a varying value with every predetermined time of the intake pressure is made to be a coefficient of correction, which is then attenuated every rotation of said engine or every predetermined time interval at a predetermined attenuation rate to zero.

8. Electronic fuel injecting method for an internal combustion engine, wherein a basic injection time is obtained in accordance with an intake pressure of said engine and an engine rotational speed, and, during transition, said basic injection time is corrected in accordance with the operating conditions of said engine so as to determine a fuel injection time, characterized in that a throttle valve opening decrease correction in which a correction value is obtained in accordance with a decreasing speed in opening of a throttle valve, and an intake pressure decrease correction in which a correction value is obtained in accordance with a decreasing speed of the intake pressure, are combined to obtain a decrease correction value for deceleration, and, when the decrease corrections are overlapped in value, the decrease correction value for deceleration is obtained through the minimal values thereof.

9. Electronic fuel injecting method for an internal combustion engine as set forth in any one of claims 1, 2, and 8, wherein said throttle valve opening decrease correction is obtained such that a negative value obtained by integrating negative values each corresponding to a varying value with every predetermined time of the throttle valve opening is made to be a coefficient of correction, which is then restored every rotation of the engine or every predetermined time interval at a predetermined restoration rate to zero.

10. Electronic fuel injecting method for an internal combustion engine as set forth in any one of claims 1, 2, and 8, wherein said intake decrease correction is obtained such that a negative value obtained by integrating negative values each corresponding to a varying value with every predetermined time of the intake pressure is made to be a coefficient of correction, which is then restored every rotation of said engine or every predetermined time interval at a predetermined restoration rate to zero.

11. Electronic fuel injection device for an internal combustion engine, comprising:

an intake air temperature sensor for detecting the temperature of intake air taken in;

a throttle sensor including an idle switch for detecting whether a throttle valve is in an idle opening or not and a potentiometer for generating a voltage output proportional to the opening of the throttle valve;

an intake pressure sensor for detecting an intake pressure;

an injector or injectors for blowing fuel out into the engine;

a crank angle sensor for outputting a crank angle signal in accordance with a rotation of the engine;

a coolant temperature sensor for detecting the temperature of engine coolant; and a digital control circuit wherein a basic injection time is obtained in accordance with an intake pressure fed from the intake pressure sensor and an engine rotational speed obtained from an output from the crank angle sensor, the basic injection time thus obtained is corrected in accordance with at least an output from the throttle sensor and the temperature of engine coolant fed from the coolant temperature sensor to determine a fuel injection time and output an injector opening time signal to the injector, and further, an after-idle increase correction in which a correction value is increased to a predetermined level when the idle switch is turned "OFF", a throttle valve opening increase or decrease correction in which a correction value is obtained in accordance with a changing speed in opening of a throttle valve as detected from an output from the potentiometer of the throttle sensor, and an intake pressure increase or decrease correction in which a correction value is obtained in accordance with a changing speed of the intake pressure as detected from an output from the intake pressure sensor, are combined to obtain an increase correction value for acceleration or a decrease correction value for deceleration, and, when the corrections are overlapped in value, the increase correction value for acceleration or the decrease correction value for deceleration is obtained through the maximal values or the minimal values thereof.

12. Electronic fuel injecting method for an internal combustion engine, wherein a basic injection time is obtained in accordance with an intake pressure of said engine and an engine rotational speed, and, during transition, said basic injection time is corrected in accordance with the operation conditions of said engine so as to determine a fuel injection time, characterized in that:

a throttle valve opening increase or decrease correction in which a correction value is obtained in accordance with a changing speed in opening of a throttle valve, and an intake pressure increase or decrease correction in which a correction value is obtained in accordance with a changing speed of the intake pressure, are combined to obtain an increase correction value for acceleration or a decrease correction value for deceleration; and when the corrections are overlapped in value, the increase correction value for acceleration or the decrease correction value for deceleration is obtained through the maximal values or the minimal values thereof.

13. Electronic fuel injecting method for an internal combustion engine, wherein a basic injection time is obtained in accordance with an intake pressure of said engine and an engine rotational speed, and, during transition, said basic injection time is corrected in accordance with the operating conditions of said engine so as to determine a fuel injection time, characterized in that:

a throttle valve opening increase correction in which a correction value is obtained in accordance with an increasing speed in opening of a throttle valve, and an intake pressure increase correction in which a correction value is obtained in accordance with an increasing speed of the intake pressure, are combined to obtain an increase correction value for acceleration; and when the increase corrections are overlapped in value, the increase correction value for acceleration is obtained through the maximal values thereof.

* * * * *